US006247750B1

(12) United States Patent
Tsai

(10) Patent No.: US 6,247,750 B1
(45) Date of Patent: Jun. 19, 2001

(54) BABY CHAIR STRUCTURE

(76) Inventor: Ting-Sheng Tsai, No. 26, Chia Shin West Rd., Kang Shan Chen, Kaohsiung Hsien (TW)

( * ) Notice: Subject to any disclaimer, the term of this patent is extended or adjusted under 35 U.S.C. 154(b) by 0 days.

(21) Appl. No.: 09/624,992

(22) Filed: Jul. 25, 2000

(51) Int. Cl.[7] ..... A47C 4/48

(52) U.S. Cl. ..... 297/16.2; 297/35; 297/36; 297/45; 297/153

(58) Field of Search ..... 297/35, 36, 45, 297/153, 467, 16.2

(56) References Cited

U.S. PATENT DOCUMENTS 2,563,553 * 8/1951 Rosenjack ..... 297/36
2,919,748 * 1/1960 Alden, Sr. ..... 297/153
3,136,272 * 6/1964 Sprigman ..... 297/162 X
3,649,074 * 3/1972 McDonald et al. ..... 297/153
4,184,711 * 1/1980 Wakimoto ..... 297/16.2
4,606,576 * 8/1986 Jones ..... 297/153
6,082,813 * 7/2000 Chen ..... 297/16.2

* cited by examiner

*Primary Examiner*—Peter R. Brown
(74) *Attorney, Agent, or Firm*—Rosenberg, Klein & Lee

(57) ABSTRACT

A baby chair structure comprises legs, a seat section, arm rests and a tray. The legs are formed by four sets of cross rods, each set of cross rods has one top end jointed together with another top end of a neighboring cross rod to connect with a block which has an upright rod extending therefrom forming a conical shaped frame. The rear end upright rods are connected to the rear ends of the arm rests and then inserted into two sacks at respective sides of a back support. The front end of each arm rest has a protrusion, and the inside of the protrusion is for the front upright rod to extend therethrough. The tray comprises a pair of grooves for receiving the protrusions of the arm rests, a pair of C-rings are formed on the respective ends adapted to buckle the arm rests, and a safety belt is inserted through a hook of the tray and secure the baby.

9 Claims, 3 Drawing Sheets

BABY CHAIR STRUCTURE

BACKGROUND OF THE INVENTION

1. Field of the Invention

This relation relates to a baby chair structure, more particularly to a baby chair which is stronger and is easier to mount and dismount.

2. Description of the Prior Art

A conventional baby chair is mostly made of heavy metal, such as steel pipe which is heavy and stable. Others are made of alloy aluminum which is light in weight, thus, the chair is unstable when a baby is sitting in the chair rocks, and even fell.

In view of this, the inventor has invented this new design which is stable and easy to mount or dismount.

SUMMARY OF THE INVENTION

It is the primary object of the present invention to provide a baby chair structure which has a strong design and is more stable.

It is another object of the present invention to provide a baby chair structure which is easy to mount and to dismount.

It is a further object of the present invention to provide a baby chair structure which is compact when dismount for less storage room and is easy to carry.

DETAILED DESCRIPTION OF THE PREFERRED EMBODIMENT

Figure 1:
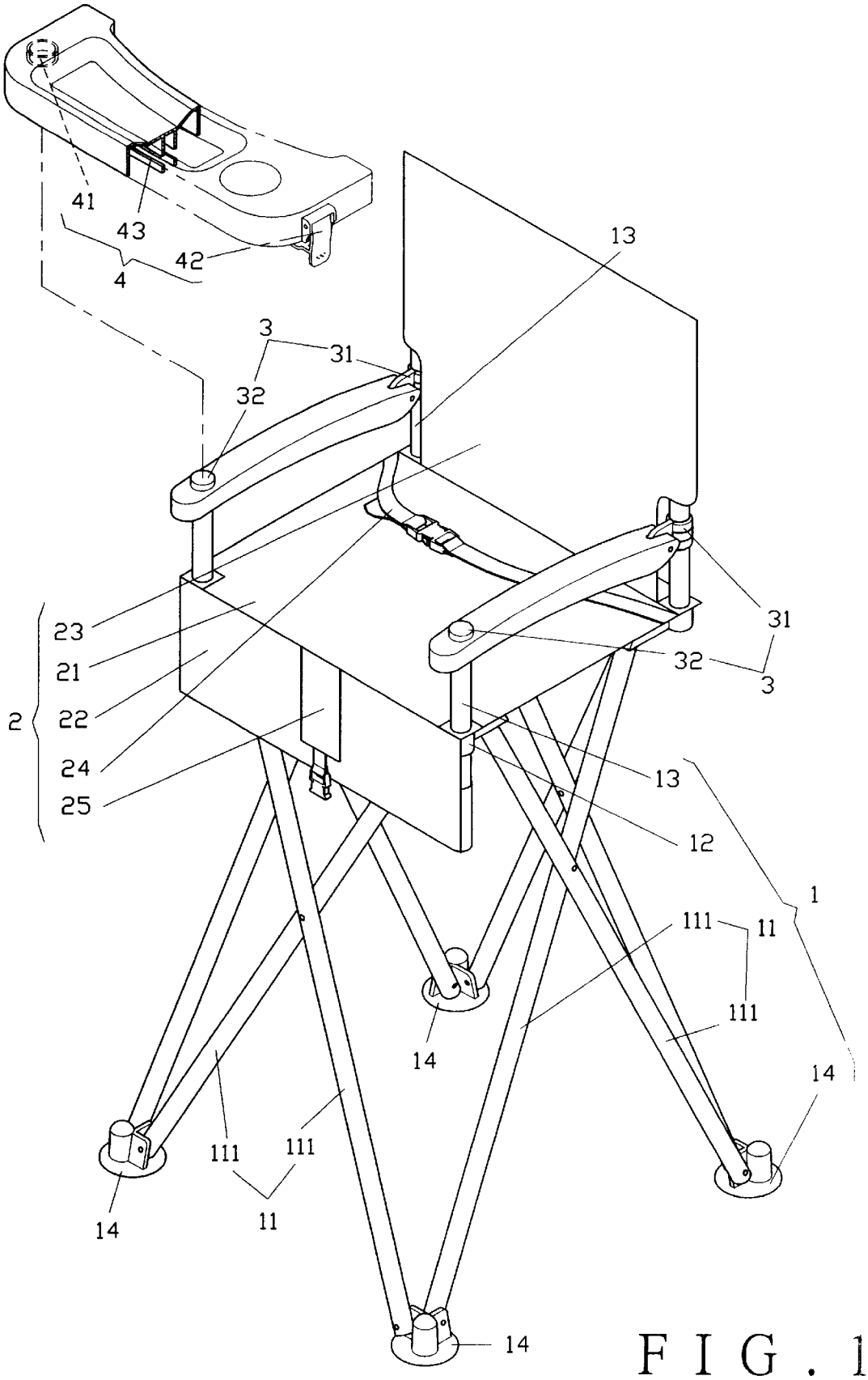
FIG. 1 is an exploded view of the present invention.

The present invention comprises legs 1, a seat section 2, arm rests 3 and a tray 4, as shown in FIG. 1.

Legs 1 are formed by four sets of cross rods 11. Each set of the cross rods 11 is formed with two rods 111 crossing each other. The top end of each rod 111 of each cross rod 11 is jointed together by the rod 111 next to it to secure with a connecting block 12 to form a conical shaped frame and whereas the bottom end of the rod 11 is secured to a stand 14. The connecting block 12 comprises an upright rod 13.

Figure 3:
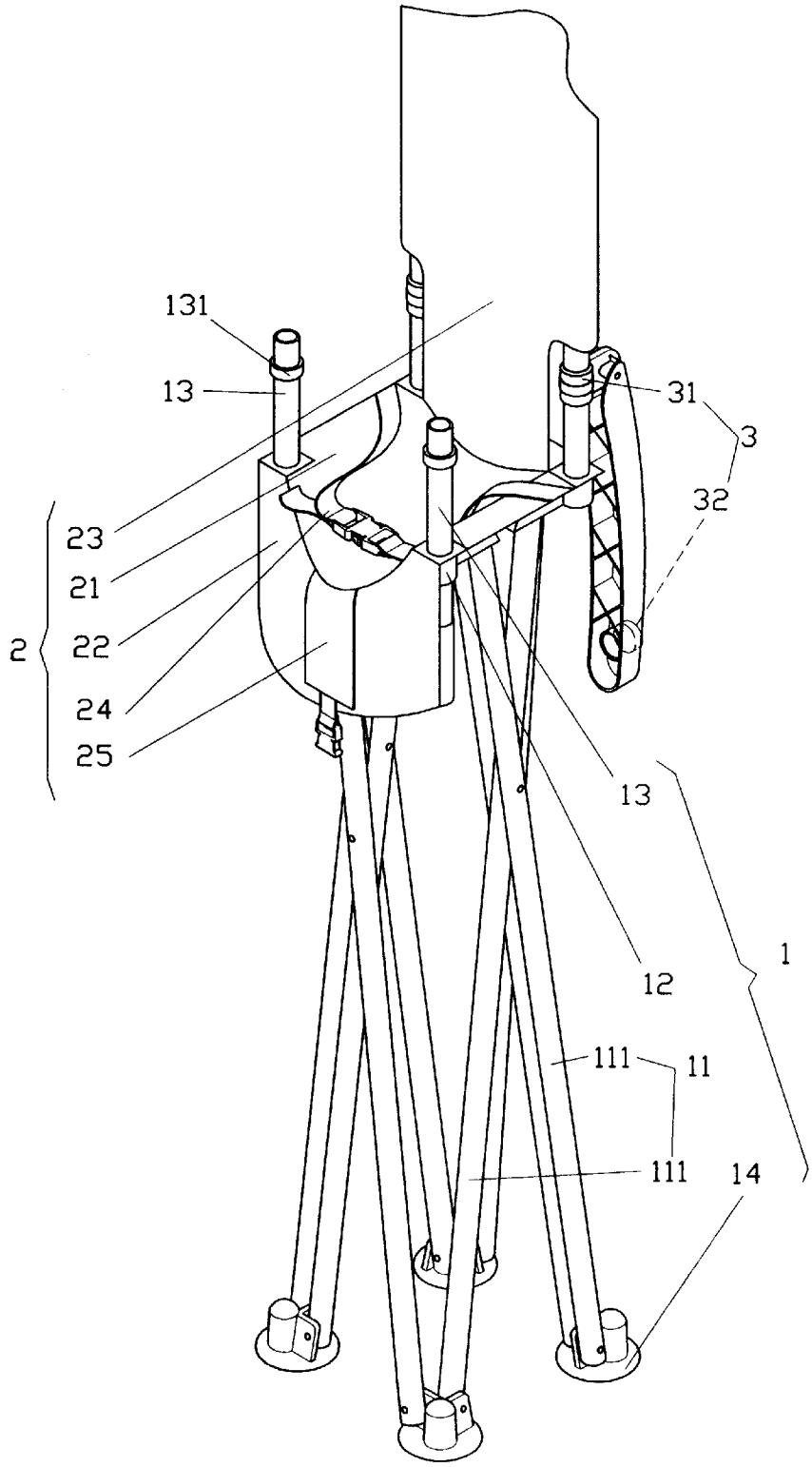
FIG. 3 is a perspective view showing the chair is folded.

The seat section 2 is made of canvas material, and is composed of a seat 21, a foot rest 22 secured to the bottom end of the seat 21, a back support 23 secured to the top end of the seat 21, and safety belts 24 and 25. Both of the foot rest 22 and the back support 23 are formed with sacks for the upright rod 13 to extend therein. Each front upright rod 13, as shown in FIG. 3, has a stop ring 131 at the upper portion, and whereas the safety belt 24 is secured at two sides of the seat section 2 while the safety belt 25 is secured tat the front center portion.

Each arm rest 3 has a ring 31 at its rear end, and a protrusion 32 at the front end thereof.

The tray 4 has a pair of grooves 41 at respective sides corresponding to the protrusions 32 both in size and in position. A pair of C-rings 42 at respective ends thereof and a hook 43 is formed at the bottom center portion adapted for the safety belt 25 to extend therethrough.

Figure 2:
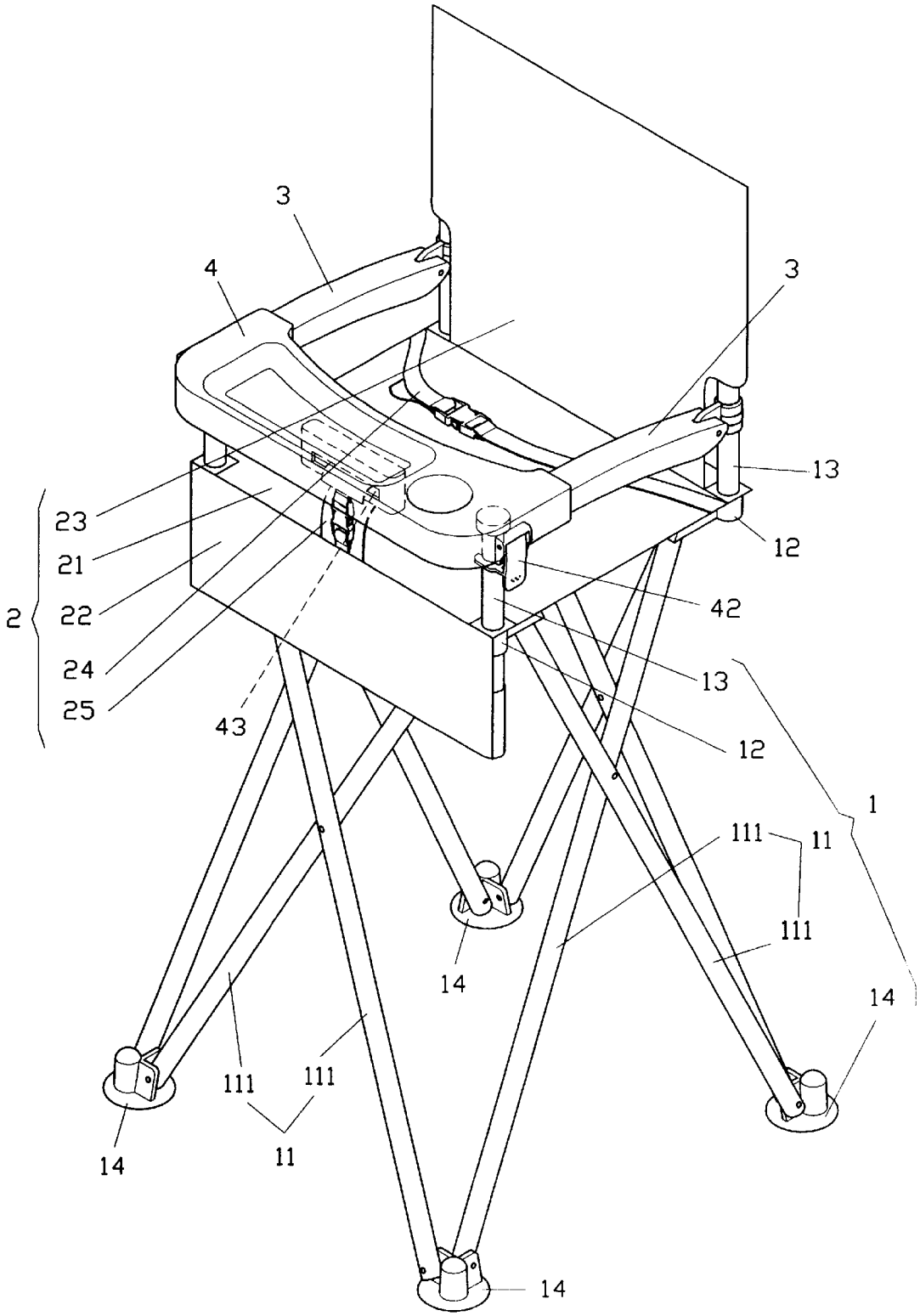
FIG. 2 is a perspective view of the present invention.

Referring now made to FIG. 2, each of the upright rods 13 at the rear end of the leg 1 is connected to the ring 31 of the rear end of each arm rest 3. The upper section of the rear upright rods 13 are inserted into the sacks of the back support 23 and the lower section of the front upright rods 13 are inserted into the sacks of the foot rest 22. The upper section of each front upright rods 13 is inserted into the arm rest 3 having a stop ring 131. The extending portion of the front upright rods 13 will then insert into the grooves 41 of the tray 4, then buckle up of the C-rings 42 to the front upright rods 13 to secure the tray 4 at place. The safety belt 25 is then inserted through the hook 43.

In practice, upon baby is seating in the seat section 2 of the baby chair, the weight of the baby against the seat section 2 will make the foot rest 22 and back support 23 to be even secured. The conical structure of the legs 1 along with the safety belts 24 and 25, will provide a safer chair.

To fold the chair, as shown in FIGS. 2 and 3, the safety belt 25 is pulled outward from the hook 43, the C-rings 42 is unbuckled and the tray 4 is able to be pulled away. The arm rests 3 are pulled to detach from the front upright rods 13, wherein the rings 31 of the rear arm rests 3 connected to the rear upright rods 13 are able to swing to the rear end of the back support 23. To pull the seat 21 up brings the legs 1 up simultaneously and each set of the cross rods 11 will be folded and ready for storage or carriage.

I claim:

1. A collapsible high chair comprising:

(a) a reconfigurable seat section including seat and back support portions;

(a) a plurality of leg assemblies supportively coupled to said seat section, each said leg assembly including at least a pair of rods cross-coupled one to the other in pivotal manner for displacement one relative to the other between collapsed and extended configurations, each said rod in said extended configuration extending between upper and lower ends thereof outward beyond a lateral periphery defined by said seat section;

(c) a plurality of connecting blocks each joining an adjacent pair of said leg assemblies, each said connecting block being coupled to said upper end of at least one said rod of each said adjacent leg assembly pair, each said connecting block having an upwardly extending upright rod portion engaging said seat section; and, (d) a plurality of stands each joining an adjacent pair of said leg assemblies, each said stand being coupled to said lower end of at least one said rod of each said adjacent leg assembly pair.

2. The collapsible high chair as recited in claim 1 comprising four said leg assemblies, each said leg assembly including two said cross-coupled rods.

3. The collapsible high chair as recited in claim 2 wherein each said stand is pivotally coupled to said lower ends of said adjacent leg assembly pair rods.

4. The collapsible high chair as recited in claim 1 further comprising a pair of arm rests each coupled to extend between a pair of connecting block upright rod portions, each said arm rest having a rear end pivotally coupled to one said connecting block upright rod portion.

5. The collapsible high chair as recited in claim 4 wherein said seat and back support portions of said seat section form flexible panels, each said seat and back support portion having formed thereon a pair of sacks for respectively receiving at least partially therein a pair of said connecting block upright rod portions.

6. The collapsible high chair as recited in claim 5 further comprising a tray releasably coupled to extend between a pair of said connecting block upright rod portions, said tray having formed thereon a pair of C-rings for respectively buckling to said upright rod portions, said tray having formed thereon a bottom hook.

7. The collapsible high chair as recited in claim 6 wherein said seat section includes a foot rest coupled to said seat.

8. The collapsible high chair as recited in claims 6 wherein said seat section includes a safety belt extending therefrom, said safety belt engaging said bottom hook of said tray in releasably locked manner.

9. The collapsible high chair as recited in claim 6 wherein each said arm rest has formed at a front end thereof a protrusion for retentively engaging said tray.

* * * * *